US007281537B2

(12) United States Patent
Correia

(10) Patent No.: US 7,281,537 B2
(45) Date of Patent: Oct. 16, 2007

(54) MULTI-STATION BLOCK-TEXTURE MODIFYING SYSTEM AND BLOCK-SPACER

(75) Inventor: Horacio Correia, Lachenaie (CA)

(73) Assignee: Rinox Inc., Terrebonne (CA)

( * ) Notice: Subject to any disclaimer, the term of this patent is extended or adjusted under 35 U.S.C. 154(b) by 155 days.

(21) Appl. No.: 11/144,193

(22) Filed: Jun. 3, 2005

(65) Prior Publication Data

US 2006/0272629 A1 Dec. 7, 2006

(30) Foreign Application Priority Data

Jun. 2, 2005 (CA) ..... 2509064

(51) Int. Cl.
*B28D 1/00* (2006.01)

(52) U.S. Cl. ..... 125/26; 125/23.01; 125/40; 451/465; 451/184

(58) Field of Classification Search ..... 125/23.01, 125/26, 40; 451/464, 465, 466, 184, 508, 451/109

See application file for complete search history.

(56) References Cited

U.S. PATENT DOCUMENTS

| | | | | |
|---|---|---|---|---|
| 3,756,216 | A * | 9/1973 | Fletcher et al. | 125/23.01 |
| 4,256,078 | A * | 3/1981 | Whitty | 125/3 |
| 4,419,065 | A | 12/1983 | Cox | |
| 5,496,206 | A * | 3/1996 | Young | 451/260 |
| 5,947,104 | A * | 9/1999 | Li | 125/23.01 |
| 6,540,501 | B1 | 4/2003 | Bott | |
| 6,668,816 | B1 * | 12/2003 | Pedersen et al. | 125/23.01 |
| 2004/0007227 | A1 * | 1/2004 | Pederson et al. | 125/23.01 |
| 2004/0089283 | A1 * | 5/2004 | Pederson et al. | 125/12 |
| 2004/0144378 | A1 * | 7/2004 | Price | 125/26 |

FOREIGN PATENT DOCUMENTS

| | | |
|---|---|---|
| CA | 2343338 | 4/2001 |
| CA | 2350979 | 6/2001 |
| CA | 2392934 | 7/2002 |
| EP | 0 816 031 | 1/1998 |
| EP | 1211036 | 6/2002 |
| JP | 04175106 | 9/1990 |
| JP | 04194202 | 11/1990 |
| JP | 09242004 | 3/1996 |
| JP | 11042627 | 7/1997 |
| WO | WO2004078441 | 9/2004 |

* cited by examiner

*Primary Examiner*—Eileen P. Morgan
(74) *Attorney, Agent, or Firm*—Ladas & Parry LLP

(57) ABSTRACT

Disclosed herein is a block-texture-modifying apparatus for modifying the surface texture of blocks. The apparatus comprises a support for supporting blocks thereon, a multi-station block-texture modifier for engaging blocks on the support, and a translational displacer for imparting translational displacement between blocks on the support and the multi-station block-texture-modifier. The multi-station block-texture modifier comprises a pressure-applying station for applying a sustained pressure to blocks engaged thereby, and an impacting station for applying interrupted impact on blocks engaged thereby. The multi-station block-texture modifier modifies the surface texture of blocks on said support during said translational displacement. Also disclosed herein is a method for modifying the surface texture of blocks.

57 Claims, 8 Drawing Sheets

MULTI-STATION BLOCK-TEXTURE MODIFYING SYSTEM AND BLOCK-SPACER

FIELD OF THE INVENTION

The present invention relates to an apparatus and a method for modifying the texture surface of pre-cast blocks. More specifically, the present invention is concerned with a multi-station block texture modifying apparatus and method and block-spacer for spacing blocks during texture modification.

BACKGROUND OF THE INVENTION

Block-texture modifying apparatuses and methods are known in the art. These include block-tumblers or block-conveyors that move blocks through variety of stations that act on their textures.

Conventional block-conveying systems include a support table for moving the blocks thereon as they are acted on during texture surface modification.

The following are examples of block-texture modifying apparatuses.

Canadian Patent Application No. 2,343,338 teaches an apparatus for roughing the surfaces of concrete casted blocks. A roller having chains is provided that is spaced above blocks that are being moved on a surface. The blocks are supported on a support table. The support table has a flat upper surface. The support table has a flat upper surface. The support table includes holes through which pins are projected in order to tilt the bottom surfaces of the blocks hence tilting the whole block at predetermine d locations in order for the chain to impact the blocks on their upper surfaces at different locations.

Canadian Patent Application No. 2,350,979 teaches a system for modifying the texture of blocks. The system includes texturing elements that are on support cables which spin and which are brought closer to the block in order to bring the texturing elements in contact with the block for impacting the surface. The texturing elements can be moved at different angles in order to impact the block's surfaces in different areas during the translational movement of the block.

Canadian Patent Application No. 2,392,934 teaches a concrete texture machine for modifying the surface texture of stone blocks. The machine conveys concrete blocks at a pitching station having opposed pitching blades. Each of the blades have a forward projecting cutting edge that are displaced towards and away from one another at predetermined distances.

European Patent Application No. 1211036 teaches a device for artificially ageing stones. This device includes top and bottom rollers with mangling elements that engage the edges stones passed therebetween in order to break and mangles these edges.

A limitation of these prior art apparatuses is that they do not provide for the blocks to be spaced apart at a constant distance when acting on them. Furthermore, these prior art apparatuses are inconvenient for acting on the edges of the blocks.

Japanese Patent Application No. 04194202 teaches a spacer which functions to create a gap between mutual blocks in order to make it look wide in external appearance. The spacer is used for the construction of the blocks.

The spacers of the prior art are not constructed for the modifying pre-cast blocks.

Hence, the prior art teaches chains on a spinning longitudinal member to impact the surface of concrete blocks, rollers for engaging the edges of blocks as well as spacers for building and laying concrete blocks are also known.

A general limitation of the prior art is that is does not provide an apparatus and method that provides easy access to the block edges so as to act thereon as well as various block-texture modifying actions that modify these edges accordingly.

OBJECTS OF THE INVENTION

An object of the present invention is to provide an improved block-texture modifying apparatus and method.

SUMMARY OF THE INVENTION

More specifically, in accordance with the present invention, there is provided a block-texture-modifying apparatus for modifying the surface texture of blocks, the apparatus comprising:

a support for supporting blocks thereon;

a multi-station block-texture modifier for engaging blocks on the support, the multi-station block-texture modifier comprising:

a pressure-applying station for applying a sustained pressure to blocks engaged thereby, and an impacting station for applying interrupted impact on blocks engaged thereby; and a translational displacer for imparting translational displacement between blocks on the support and the multi-station block-texture-modifier wherein the multi-station block-texture modifier modifies the surface texture of blocks on said support during said translational displacement.

In an embodiment, the support comprises at least one panel member for supporting blocks thereon, the panel member is configured to expose opposite bottom edges of blocks.

In an embodiment, the pressure applying station comprises at least one pressure-applying element adapted to so engage the surface texture of blocks during the translational displacement as to add pressure thereto thereby modifying block texture surfaces.

In an embodiment, pressure-applying element is so positioned as to exert pressure on the top edge of a block thereunder. In an embodiment, the pressure-applying element is so positioned as to apply pressure on a respective top edge of two adjacent blocks thereunder.

In an embodiment, the pressure-applying element is so positioned as to exert pressure on the bottom edge of a block thereabove. In an embodiment, the pressure-applying element is so positioned as to apply pressure on a respective bottom edge of two adjacent blocks thereabove. In an embodiment, the pressure-applying station further comprises a top stopper above blocks engaged by the pressure-applying elements to maintain blocks in position when pressure is exerted thereon.

In an embodiment, the pressure applying station comprises at least one top pressure-applying element and at least one bottom pressure-applying element, the top pressure-applying element being so positioned as to exert pressure on the top edge of a block thereunder, the bottom pressure-applying element being so positioned as to exert pressure on the bottom edge of a block thereabove. In an embodiment, the top pressure-applying element is so positioned as to apply pressure on a respective top edge of two adjacent blocks thereunder, the bottom pressure-applying element being so positioned as to apply pressure on a respective bottom edge of two adjacent blocks thereon. In an embodiment, the at least one top pressure-applying element is collinear with the at least one bottom pressure-applying element.

In an embodiment, the pressure-applying element is mounted to a longitudinal support member. In an embodiment, the pressure-applying element comprises a roller rotatable about an axis defined by the longitudinal support member. In an embodiment, this longitudinal support member is reciprocally moveable towards and away blocks engaged by the pressure-applying elements so as to selectively modulate the sustained pressure applied thereby.

In an embodiment, the pressure-applying members are expandable so as to selectively modulate the sustained pressure applied thereby.

In an embodiment, the pressure-applying element comprises a pressure-applying roller.

In an embodiment, the pressure-applying station is so configured as to selectively modulate the sustained pressure exerted on blocks.

In an embodiment, the impacting station comprises at least one impacting element. In an embodiment, the impacting element comprises a protruding member. In an embodiment, the protruding element comprises a chain member. In an embodiment, the impacting element is mounted to an actuator. In an embodiment, the actuator is a rotatable longitudinal member. In an embodiment, the actuator so moves the impacting element as to repeatedly and interruptingly impact blocks.

In an embodiment, the impacting element is so positioned as to impact the top edge of blocks thereunder. In an embodiment, the impacting element is positioned as to impact the top edge of two adjacent blocks thereunder.

In an embodiment, the impacting element is positioned as to impact the bottom edge of blocks thereabove. In an embodiment, the impacting element is positioned as to impact the bottom edge of two adjacent blocks thereabove.

In an embodiment, the impacting station comprises at least one top impacting element and at least one bottom impacting element, the top impacting element being so positioned as to impact the top edge of a block thereunder, said bottom impacting element being so positioned as to impact the bottom edge of a block thereabove. In an embodiment, the at least one top and bottom impacting elements are collinear, the top impacting element impacting the adjacent top edges of two adjacent blocks thereunder, said bottom impacting element impacting the adjacent bottom edges of two adjacent blocks thereover.

In an embodiment, the translational displacer comprises a push-member for pushing blocks along said support. In an embodiment, the push member is mounted to an actuator at one end for translational movement thereof, said push-member comprising an opposite free end including a block-engaging member for engaging blocks during said translational displacement. In an embodiment, the translational displacer comprises an actuation assembly mounted to said multi-station block-texture modifier so as to be displaced along the length of said support.

In an embodiment, the multi-station block-texture modifier further comprises a polishing station for polishing blocks engaged thereby.

In an embodiment, the polishing station comprises at least polishing element for polishing blocks. In an embodiment, the polishing element comprises a brush. In an embodiment, the polishing element is mounted to an actuator. In an embodiment, the actuator is a rotatable longitudinal member. In an embodiment, the actuator so moves said polishing element as to polish blocks.

In an embodiment, the polishing element is so positioned as to polish the top edge of blocks thereunder. In an embodiment, the polishing element is so positioned as to polish the adjacent top edges of two adjacent blocks thereunder.

In an embodiment, the polishing element is so positioned as to polish the bottom edge of blocks thereabove. In an embodiment, the polishing element is positioned as to impact the bottom edge of two adjacent blocks thereabove.

In an embodiment, the polishing station comprises at least one top polishing element and at least one bottom polishing element, said top polishing element being so positioned as to polish the top edge of a block thereunder, said bottom polishing element being so positioned as to polish the bottom edge of a block thereabove. In an embodiment, the at least one top and bottom polishing elements are collinear, said top polishing element polishing the adjacent top edges of two adjacent blocks thereunder, said bottom polishing element polishing the adjacent bottom edges of two adjacent blocks thereabove.

In an embodiment, the plurality of blocks on the support are spaced apart by a spacer. In an embodiment, the spacer provides for keeping adjacent blocks apart at a predetermined distance. In an embodiment, the spacer is a rectangular grid comprising crossed spacing members defining individual receiving areas for receiving a given block therethrough.

In accordance with another aspect of the present invention there is provided a method of modifying the surface texture of blocks, said comprising:

applying a sustained pressure to blocks; and applying interrupted impact on blocks.

In an embodiment, applying pressure comprises exerting pressure on the top edge of a block. In an embodiment, applying pressure comprises exerting pressure on respective adjacent top edges of two adjacent blocks. In an embodiment, applying pressure comprises exerting pressure on the bottom edge of a block. In an embodiment, applying pressure comprises exerting pressure on respective adjacent bottom edges of two adjacent blocks. In an embodiment, applying pressure comprises exerting pressure on a top edge and a bottom edge of a block. In an embodiment, applying pressure comprises exerting pressure on respective adjacent top edges and respective adjacent bottom edges of two adjacent blocks. In an embodiment, applying pressure comprises selectively modulate said sustained pressure applied.

In an embodiment, applying interrupted impact comprises impacting the top-edge of blocks. In an embodiment, applying interrupted impact comprises impacting respective adjacent top edges of two adjacent blocks. In an embodiment, applying interrupted impact comprises impacting the bottom edge of a block. In an embodiment, applying interrupted impact comprises impacting respective adjacent bottom edges of two adjacent blocks. In an embodiment, applying interrupted impact comprises impacting a top edge and a bottom edge of a block. In an embodiment, applying interrupted impact comprises impacting respective adjacent top edges and respective adjacent bottom edges of two adjacent blocks.

In an embodiment, the method further comprises polishing blocks after having applied both the sustained pressure and the interrupted impact thereon.

In an embodiment, polishing comprises polishing the top edge of blocks. In an embodiment, polishing comprises polishing respective adjacent top edges of two adjacent blocks. In an embodiment, polishing comprises polishing the bottom edge of a block. In an embodiment, polishing comprises polishing respective adjacent bottom edges of two adjacent blocks. In an embodiment, polishing comprises polishing a top edge and a bottom edge of a block. In an embodiment, polishing comprises polishing respective adjacent top edges and respective adjacent bottom edges of two adjacent blocks.

In an embodiment, the method further comprises spacing apart a plurality of blocks. In an embodiment, spacing comprises keeping adjacent blocks apart at a pre-determined distance.

In accordance with another aspect of the present invention, there is provided a spacer for spacing adjacent blocks apart at a predetermined distance when the modifying the surface texture of these blocks, said spacer comprising spacing elements for placing between adjacent blocks.

In an embodiment, the spacing elements comprises crossed members defining individual areas for receiving a given block therethrough. In an embodiment, the spacing elements are so configured as to expose the top and bottom edges of blocks. In an embodiment, the spacing elements are of a substantially equal thickness, said receiving areas being of substantially equal sizes.

In an embodiment, the spacer comprises peripheral enclosing members for enclosing a plurality of blocks therein. In an embodiment, the enclosing elements are so configured as to expose the top and bottom edges of blocks.

In an embodiment, the spacer comprises four peripheral enclosing members defining a generally rectangular shape, longitudinal spacing members extending between opposite peripheral enclosing members, the spacing members extending between one pair of opposite enclosing members crossing the spacing members extending between another pair of opposite enclosing members thereby defining individual receiving areas, each area configured to receiving a block therein.

Other objects, advantages and features of the present invention will become more apparent upon reading of the following non restrictive description of embodiments thereof, given by way of example only with reference to the accompanying drawings.

BRIEF DESCRIPTION OF THE DRAWINGS

In the appended drawings where like elements are referenced by like reference numerals and in which.

DESCRIPTION OF THE EMBODIMENTS

With reference to the appended drawings, embodiments of the invention as well as the operation will be described herein so as to exemplify a mode of the invention only and not limit the scope thereof.

Figure 1:
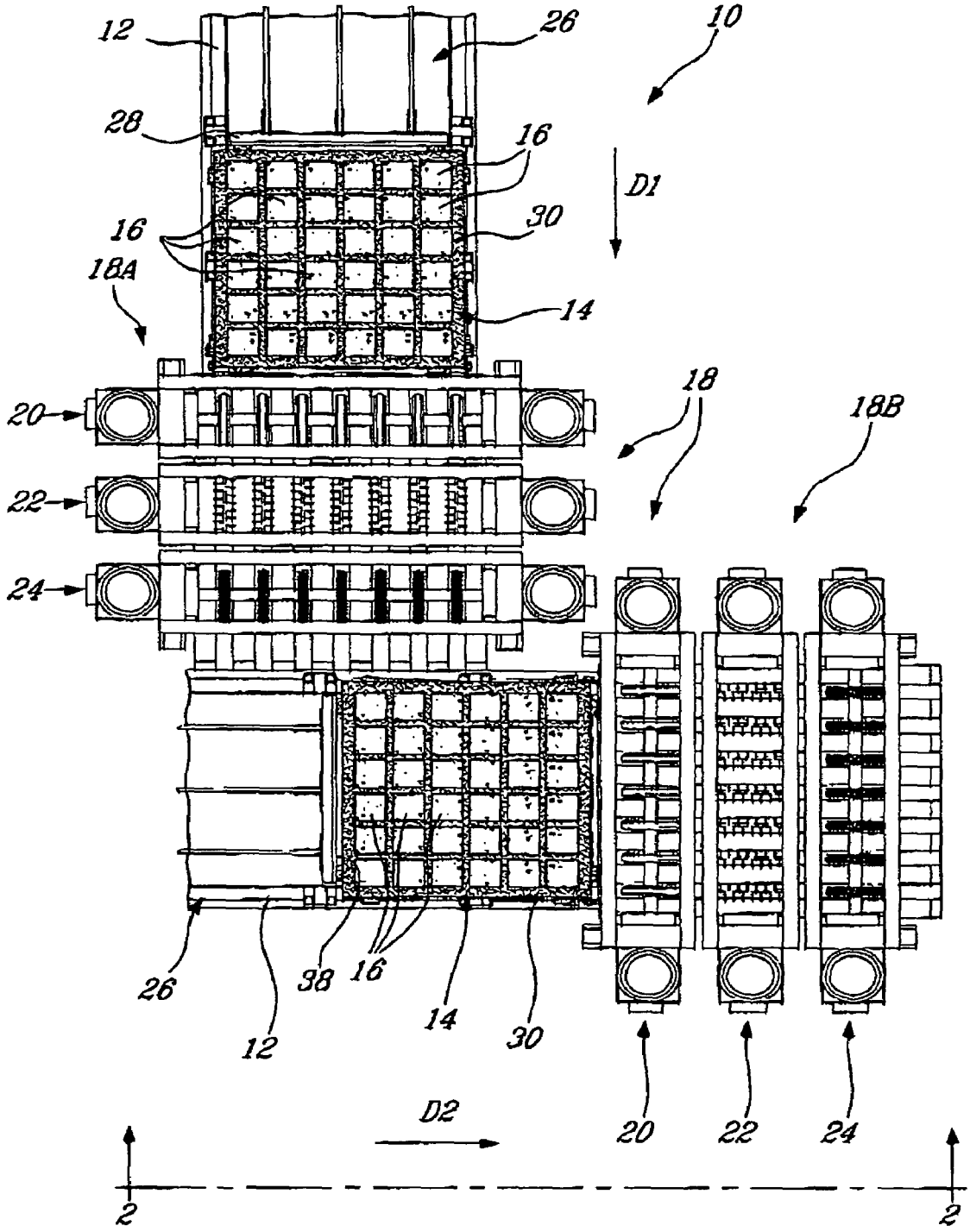
FIG. 1 is a top plan view of the block-texture modifying apparatus in accordance with an embodiment of the present invention.

FIG. 1 shows the multi-station block texture modifying apparatus 10. This apparatus 10 includes a support 12 for supporting a plurality 14 of blocks 16 thereon.

The multi-station block texture modifying apparatus 10 comprises a multi-station block texture modifier 18. In this embodiment, there are two multi-station block texture modifiers 18A and 18B. In other embodiments, apparatus 10 may include one or more multi-station block texture modifier 18. In this embodiment, each multi-station block texture modifier 18 respectively includes a pressure-applying station 20, an impacting station 22, and a polishing station 24. In this embodiment, stations 20, 22 and 24 are in an upstream arrangement.

In accordance with the present invention, the multi-station block texture modifier 18 may include only a pressure-applying station 20 and an impacting station 22. Furthermore, in another embodiment, the impacting station 22 can be upstream of the pressure-applying station 20.

The multi-station block texture modifying apparatus 10 also includes a translational displacer 26 for imparting translational displacement between blocks 16 on the support 12 and the multi-station block texture modifier 18.

In this embodiment, the support 12 is a table that provides for the plurality 14 of blocks 16 to be moved thereon through the multi-station block texture modifier 18. As shown in FIGS. 3, 4, 5, 7 and support 12 includes longitudinal separate panels 13 which are so spaced apart as to expose the bottom edges of blocks 16 as will be further explained below The translational displacer 26 is a push member. The push member 26 has one end (not shown) mounted to an actuator (not shown) for translational movement thereof, and a free block engaging end 28 for pushing the engaging blocks 16 or a plurality 14 of blocks 16 on the support and through the multi-station block texture modifier 18.

In another embodiment, the translational displacer can comprise a conveyor as is understood by the skilled artisan to displace blocks 16 relative to the modifier 18. Still in a further embodiment, the translational displacer can comprise a wide variety of actuation assemblies for displacing the modifier 18 relative to immobile blocks 16. In this embodiment, the modifier 18 can be displaced as a unit or its stations 20, 22 and 24 can be displaced separately. Furthermore, combinations of push members 26, conveyors and actuators to displace modifier 18 and/or its stations 20, 22 and 24 can also be contemplated within the scope of the present invention.

As shown in FIGS. 1 through 8, the blocks 16 of the plurality 14 are spaced apart by a spacer 30. As more clearly shown in FIG. 8, this spacer 30 is a rectangular-shaped grid and comprising spacing members in the form horizontal cross lateral members 32 and longitudinal members 34 thereby creating receiving areas 36 for receiving blocks 16 therethrough. The spacer grid 30 also includes enclosure members 33A, 33B, 33C and 33D for enclosing blocks 16 therein. Longitudinal spacer members 32 extend between opposite enclosure members 33C and 33D, whereas longitudinal spacer members 34 extend between opposite enclosure members 33A and 33B for a plurality 14 of blocks 16 to be moved together on the support 12. Furthermore, the grid spacer 30 provides for the blocks 16 to be spaced from each other at a predetermined constant distance. As better shown in FIG. 6, and as will be explained later, the top edges 38 and bottom edges 40 of two adjacent blocks 16 are kept apart at a predetermined constant distance allowing for the multi-station block texture modifier 18 to modify edges 38 and 40, as will be explained herein.

Figure 2:
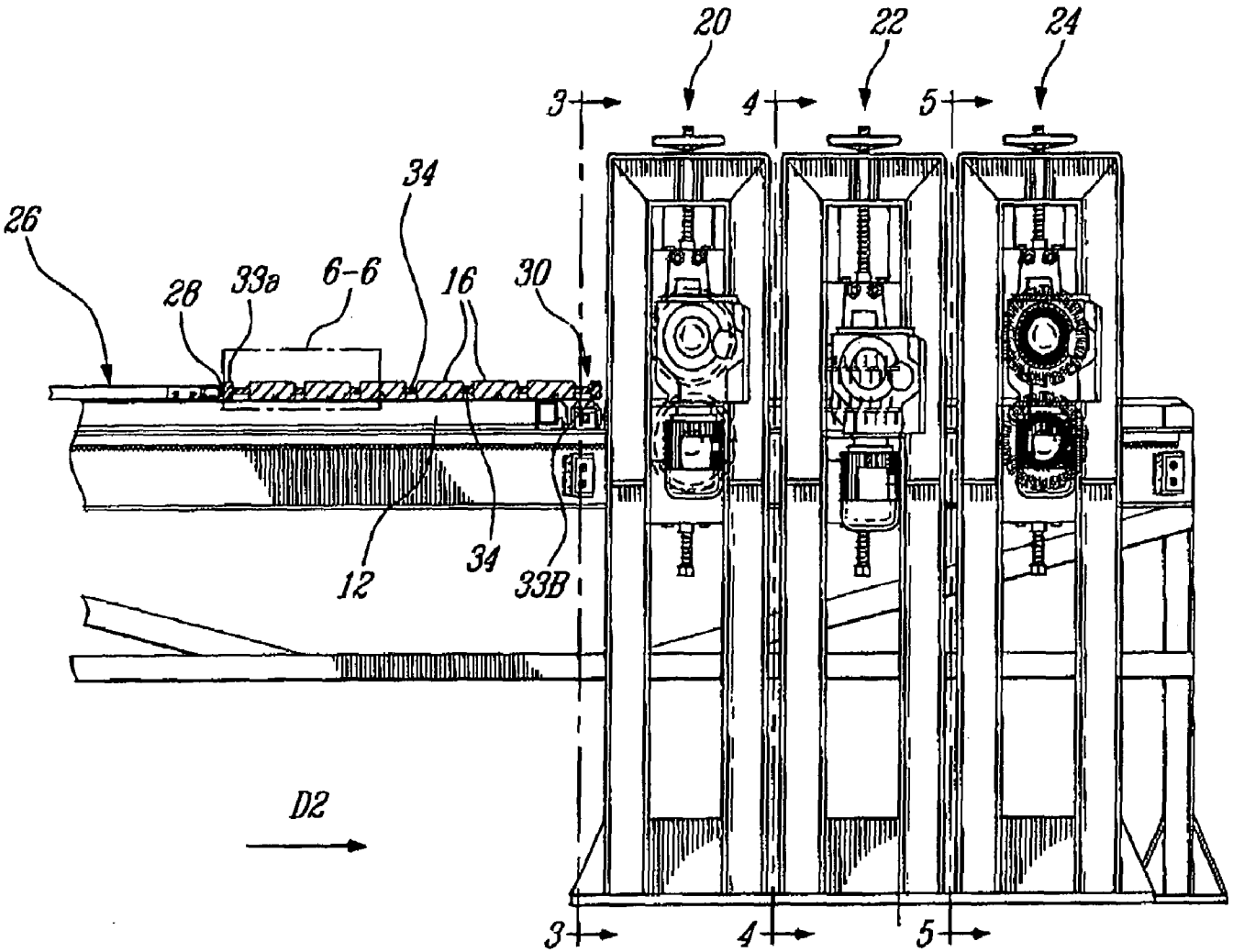
FIG. 2 is a lateral sectional view of FIG. 1, taken along line 2-2 thereof.

As better shown in FIG. 2, and as aforementioned, the multi-station block texture modifier 18 includes a pressure-applying station 20, an impacting station 22, and a polishing station 24.

Figure 3:
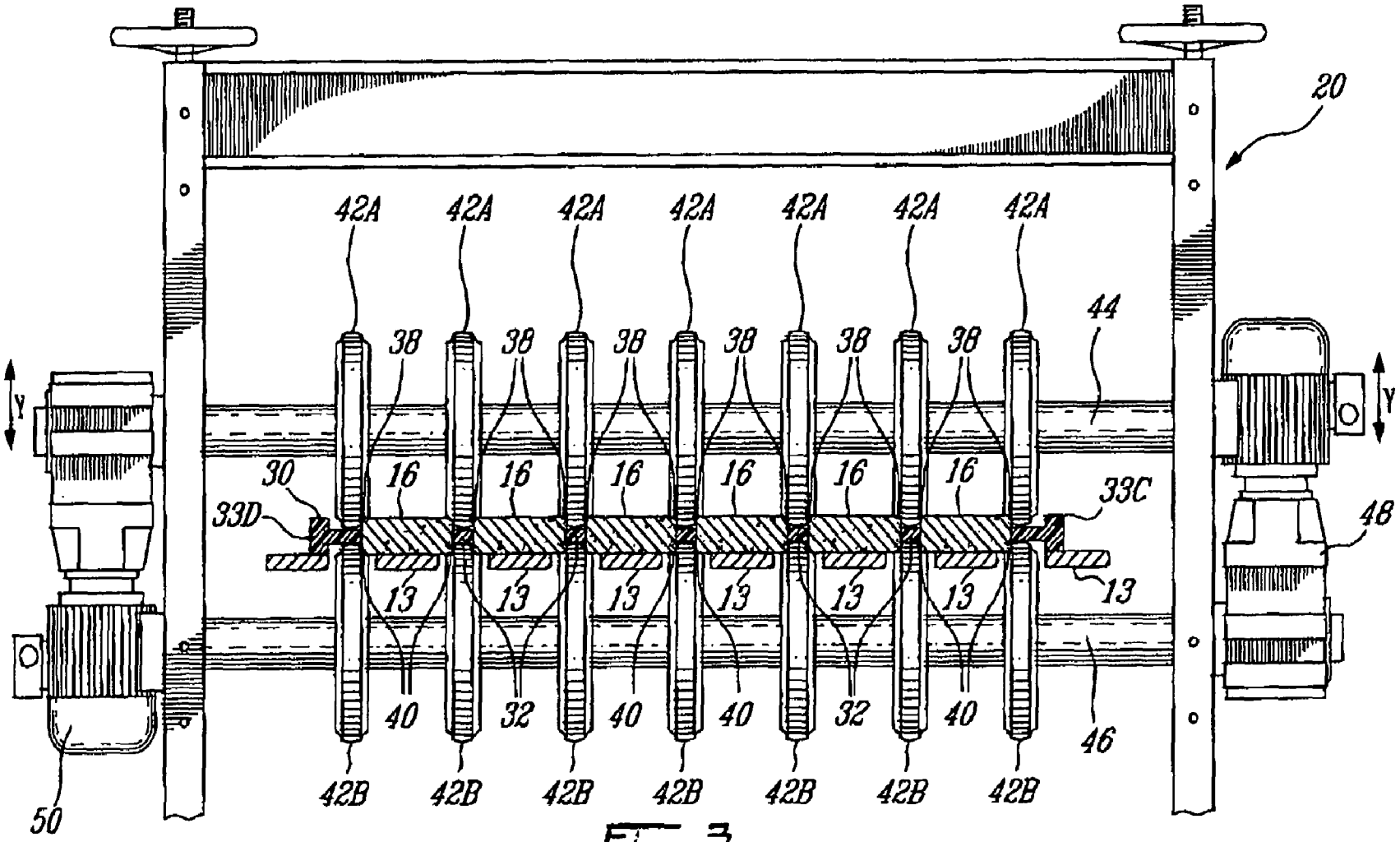
FIG. 3 is a front sectional view of FIG. 2 taken along line 3-3 thereof.

Turning to FIG. 3, there is shown the pressure-applying station 20, which serves to apply a sustained pressure to blocks 16 that are engaged thereby. The pressure-applying station 16 includes pressure-applying elements 42A and 42B, which engage the blocks 16 in order to apply a sustained pressure to the texture surface of the blocks 16 so that this texture surface is modified.

In the embodiment shown here, the pressure-applying elements 42A are top rollers mounted along a top rotating longitudinal member 44, the pressure-applying elements 42B are bottom rollers mounted along bottom longitudinal member 46, and so positioned as to respectively engage the top and bottom opposite edges 38 and 40 of blocks 16. As shown, a single given roller 42A of the top member 44 engages two opposite edges 38 of two adjacent blocks 16 and a single given roller 42B of the bottom member 46 engages two opposite edges 40 of two adjacent blocks 16. In this example the top and bottom rollers are collinear. The top and bottom longitudinal members 44 and 46 are mounted to actuators 48 and 50 respectively to rotate about their longitudinal axes.

As aforementioned, the support surface 12 also includes separate vertical members 13, which are so spaced apart as to expose the bottom edges 40 of block 16, so they can be engaged by the multi-station block texture modifier 18.

The top moveable member 44 or bottom member 46 can be moveable in an upward or downward fashion, as shown by arrow Y in order to modulate the pressure applied by a roller 42 mounted thereon. In another embodiment, the rollers 42A and 42B may be expandable, again in order to modulate the sustained pressure applied to the texture surface of the blocks 16. The foregoing features are described in PCT publication WO/2004078441, which is incorporated herein by reference.

In an embodiment, the pressure-applying station 20 may comprise only top pressure applying elements 42A. In another embodiment, the pressure-applying station 20 may comprise only bottom pressure applying elements 42B. In this case, attention is drawn to FIG. 7, which shows a bottom modifier 18C beneath panels 13 comprising bottom pressure applying, impacting and polishing stations 20B, 22B, 24B respectively. At the bottom pressure-applying station a top support 15 is positioned above the panels 13 so that when the rollers 42B act on the blocks 16, they are pushed on this top member 15.

Figure 4:
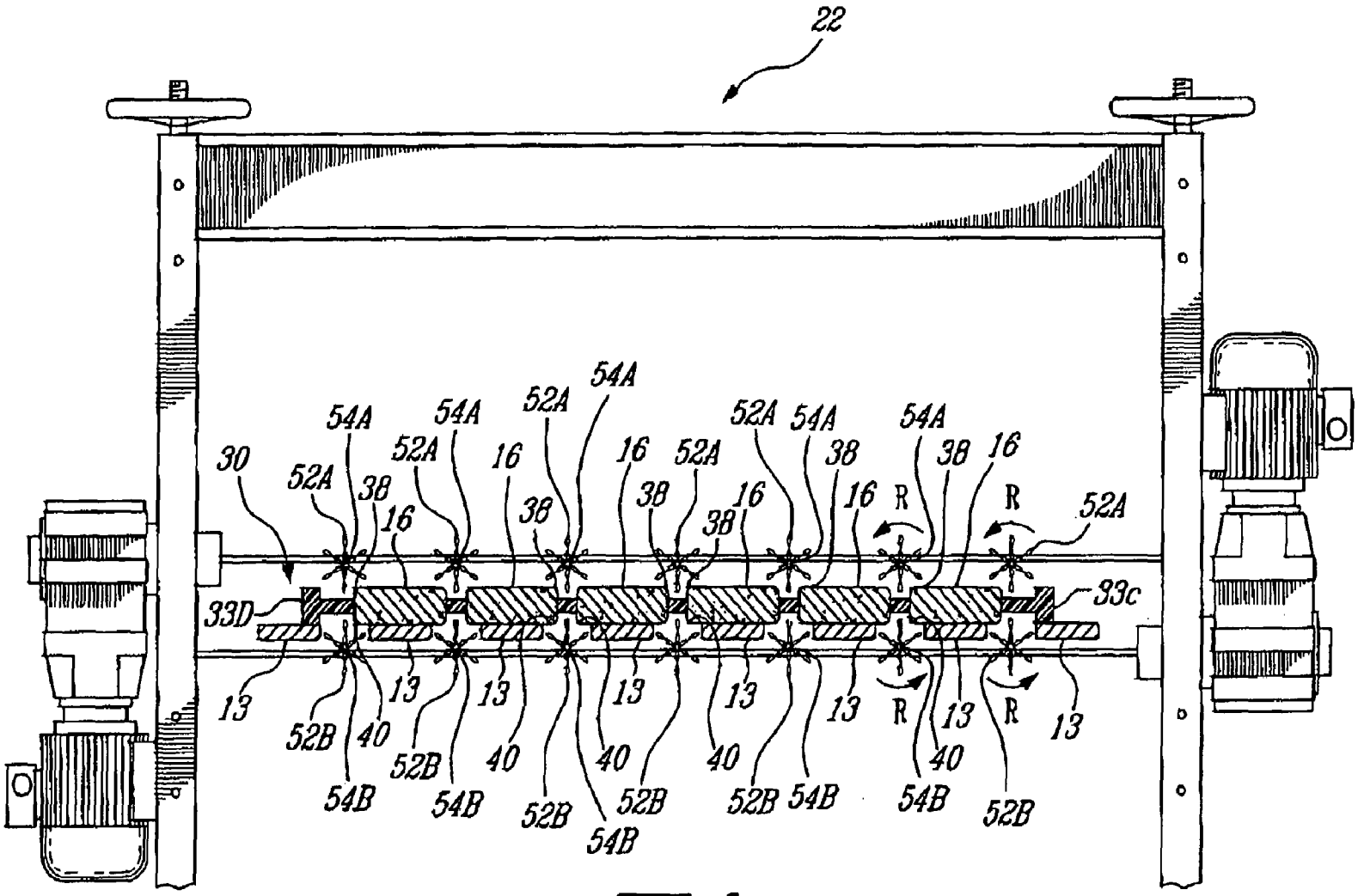
FIG. 4 is a front sectional view of FIG. 2 taken along line 44 thereof.

Turning now to FIG. 4, there is shown an impacting station 22, which includes top and bottom impacting elements 52A and 52B. In this example , these impacting elements 52A and 52B are chains extending from a rotating member in the form of a rod 54A and 54B that is mounted to an actuator in order to rotate about its longitudinal length, hence, actuating the chains 52A and 54B so that they spin in the clock wise direction shown by arrow R, of course the chains 52A and 52B can also be spun in a counter-clockwise direction, in order to impact the texture surface of blocks 16. In this example, it is the top and bottom edges 38 and 40 of the blocks 16 which are respectively impacted by the chains 52A and 52B. A shown, a given top impacting element 52A is so position as to simultaneously impact the adjacent top edges 38 of two adjacent blocks 16 and a given bottom impacting element 52B is so position as to simultaneously impact the adjacent bottom edges 40 of two adjacent blocks 16. In this example the top and bottom-impacting element 52A and 52B are collinear. In an embodiment, the impacting station 22 may comprise only top impacting elements 52A, in another embodiment the impacting station 22 may comprise only bottom impacting elements 52B. Of course impacting elements 52A and 52B can comprise any type of protrusion member for impacting the surface texture of blocks 16 as will be understood by the skilled artisan. A variety of such impacting element are described in PCT publication WO/2004078441.

Figure 5:
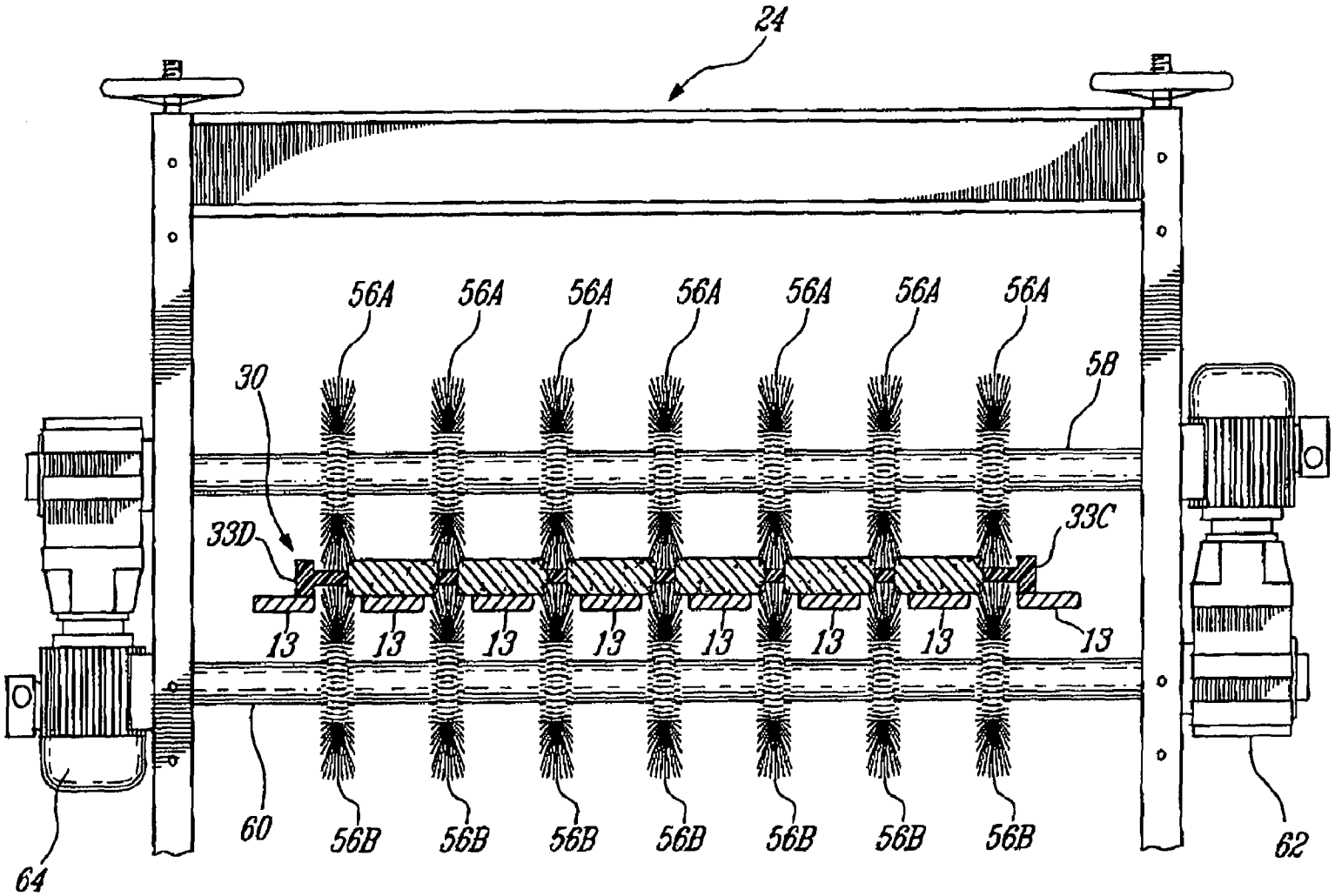
FIG. 5 is a front sectional view of FIG. 2 taken along line 5-5 thereof.

With respect to FIG. 5, there is shown the polishing station 24, which includes top and bottom polishing members 56A and 56B. These top and bottom polishing members 56A and 56B are respectively mounted along a top and bottom rotating members 58 and 60. Rotating longitudinal members 58 and 60 are mounted to respective actuators 62 and 64 so as to be actuated to rotate about their respective longitudinal axes. In this way, the top polishing member 56A will rotate along the axis formed by member 58 and the bottom polishing member 56B will rotate along the axis formed by member 60. In this example, the polishing members 56A and 56B are in the form of brushes; brushes 56A and 56B are so spaced along their respective top or bottom members 58 and 60 so as to respectively engage the top edges 38 and bottom edges 40 of blocks 16. As shown, a single given top brush 56A engages two edges 38 of two adjacent blocks 16 and a single given bottom brush 56B engages two edges 40 of two adjacent blocks 16. In an embodiment, the polishing station 24 may comprise only top polishing elements 56A or only bottom polishing elements. Of course a variety of polishing or brushing elements as is understood by a skilled artisan can be used.

Figure 6:
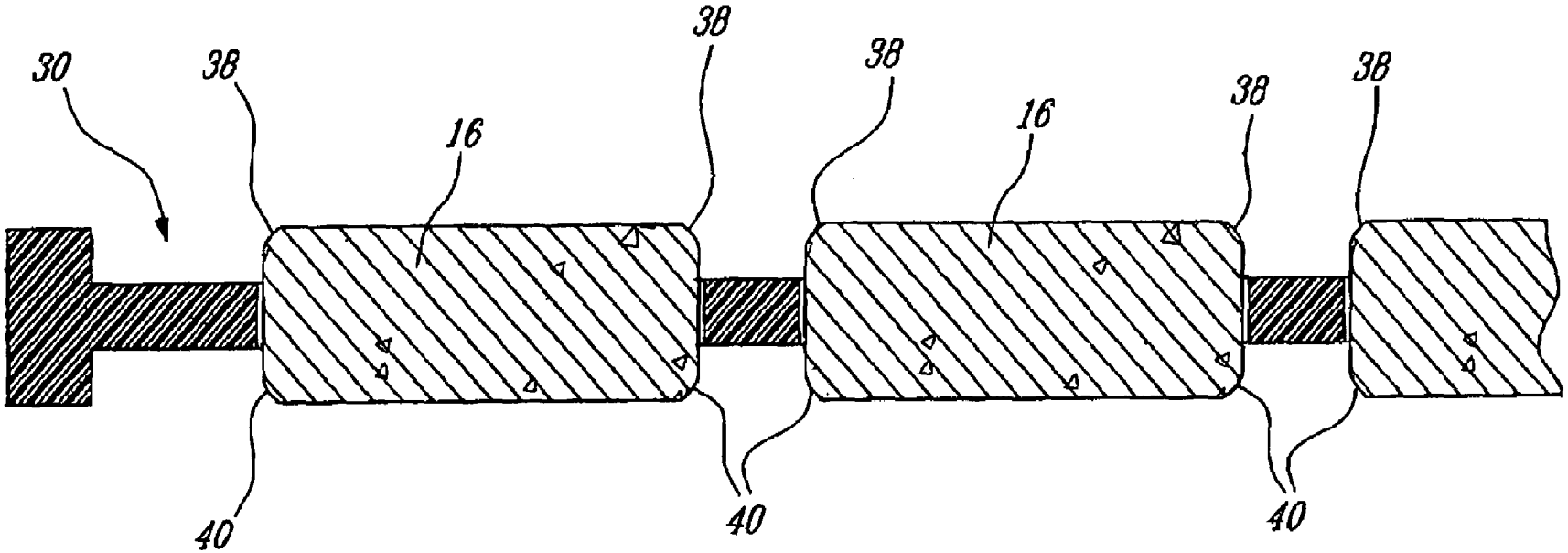
FIG. 6 is an enlarged view of the area referenced as 6 in FIG. 2.
Figure 8:
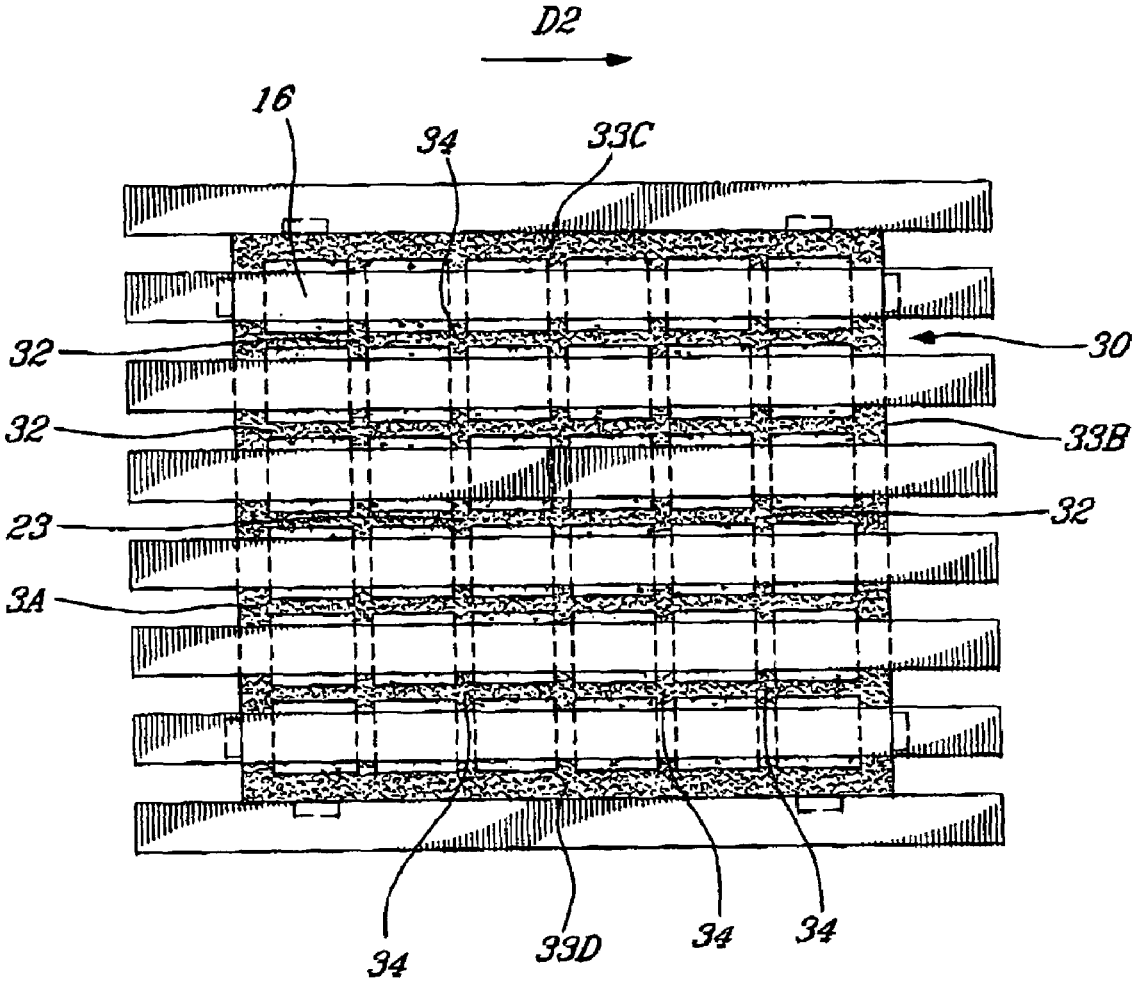
FIG. 8 is a bottom view of the support in accordance with an embodiment of the present invention.

With respect to FIGS. 6 and 8, it should be noted that the spacer 30 provides for spacing the blocks 16 at a predetermined and constant distances, the blocks 16 are laterally displaced relative to each other and this distance is provided by the width or thickness of members 32 and 34. In this way the modifier 18 has easier access to the edges 38 and the 40.

Figure 7:
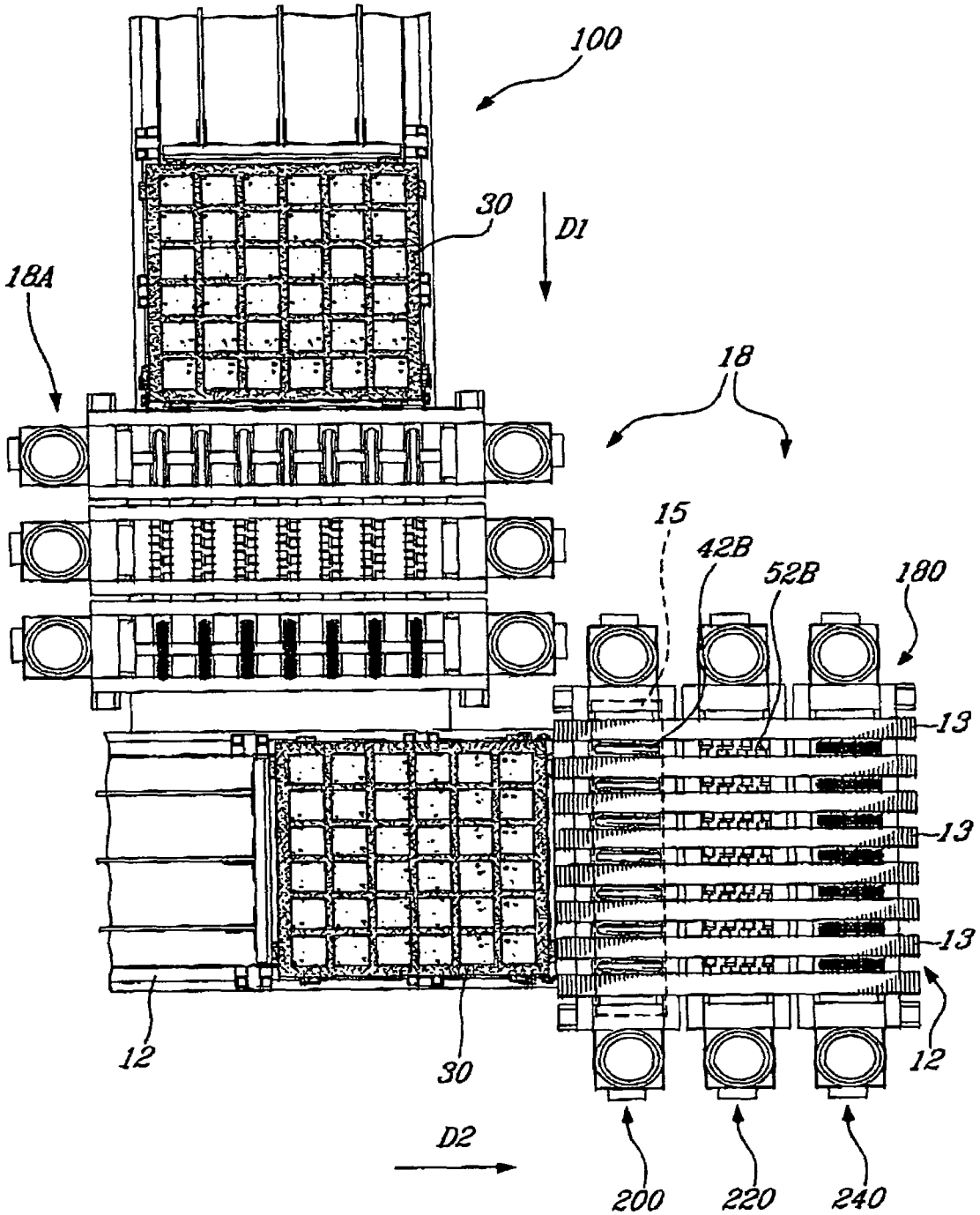
FIG. 7 is a top plan view of the block-texture modifying apparatus in accordance with an embodiment of the present invention.

Turning to FIGS. 1 and 7 and 8, there are two pairs of opposite top edges 38 and 38' and two pairs of opposite bottom edges 40 and 40'.

FIG. 7 shows a multi-station block texture modifying apparatus 100 that is similarly constructed to the multi-station block texture modifying apparatus 10 with the exception that apparatus 100 includes a multi-station block texture modifier 180 that is beneath a support 12 made up of spaced-apart vertical support members or panels 13.

FIG. 8 is a bottom view of a plurality 14 of blocks 16 on the support members 13 being spaced apart by the spacer 30. As shown, the bottom edges 40 of block 16 are so exposed as to be engaged by the bottom modifier 180. As shown in FIGS. 3, 4 and 5 these bottom support members or panels 13 provide access to the bottom edges of blocks 16.

Similarly to modifier 18, the multi-station block texture modifier 180 includes a bottom pressure applying station 200 on a bottom impacting station 220 and a bottom polishing station 240.

The bottom pressure applying station 200 includes a bottom-rotating member 46 on which are mounted impacting elements 42B in the form of rollers. This station also includes a top support 15 positioned above the block 16 in order to allow the pressure applying rollers 42B to act on edges 40 against a support member.

The impacting station 220 includes bottom-rotating members 54 on which are mounted chain members 52B in a similar fashion, as also shown in FIG. 4.

The polishing station 240 includes a bottom longitudinal member 60 having polishing elements such as brushes 56B as also shown in FIG. 5.

It should be noted that apparatus 10 or 100 also provides to impart displacement between the blocks 16 and the block-texture modifiers of the present invention in at least two directions D1 and D2 in this way both pair of opposite top edges 38 and both pairs of opposite bottom edges 40 of a single block 16 can be engaged as described above thereby, modifying the top and bottom peripheries of blocks 16.

The present invention also provides methods for modifying the texture surface of blocks. As can be ascertained by the above description, the present invention provides a method of modifying the surface texture of blocks 16 via applying a sustained pressure to blocks as well as applying interrupted impact on blocks 16.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. A block-texture-modifying apparatus for modifying the surface texture of blocks, said apparatus comprising:

a support for supporting blocks thereon;

a multi-station block-texture modifier for engaging blocks on said support, said multi-station block-texture modifier comprising:

a pressure-applying station for applying a sustained pressure to blocks engaged thereby, and an impacting station for applying interrupted impact an blocks engaged thereby; and a translational displacer for imparting translational displacement between blocks on said support and said multi-station block-texture-modifier wherein said multi-station block-texture modifier modifies the surface texture of blocks on said support during said translational displacement.

2. An apparatus according to claim 1, wherein said multi-station block-texture modifier further comprises:

a polishing station for polishing blocks engaged thereby.

3. An apparatus according to claim 1, wherein a plurality of blocks on said support are spaced apart by a spacer.

4. An apparatus according to claim 3, wherein said spacer provides for keeping adjacent blocks apart at a pre-determined distance.

5. An apparatus according to claim 3, wherein said spacer is a rectangular grid comprising crossed spacing members defining individual receiving areas for receiving a given block therethrough.

6. An apparatus according to claim 1, wherein said support comprises at least one panel member for supporting blocks thereon, said panel member configured to expose opposite bottom edges of blocks.

7. An apparatus according to claim 1, wherein said pressure applying station comprises at least one pressure-applying element adapted to so engage the surface texture of blocks during said translational displacement as to add pressure thereto thereby modifying block texture surfaces.

8. An apparatus according to claim 7, wherein said pressure-applying element is so positioned as to exert pressure on the top edge of a block thereunder.

9. An apparatus according to claim 8, wherein said pressure-applying element is so positioned as to apply pressure on a respective top edge of two adjacent blocks thereunder.

10. An apparatus according to claim 8, wherein said pressure-applying element in mounted to a longitudinal support member.

11. An apparatus according to claim 10, wherein said pressure-applying element comprises a roller rotatable about an axis defined by said longitudinal support member.

12. An apparatus according to claim 10, wherein said longitudinal support member is reciprocally moveable towards and away blocks engaged by said pressure-applying elements so as to selectively modulate the sustained pressure applied thereby.

13. An apparatus according to claim 8, wherein said pressure applying members are expandable so as to selectively modulate the sustained pressure applied thereby.

14. An apparatus according to claim 7, wherein said pressure-applying element is so positioned as to exert pressure on the bottom edge of a block thereabove.

15. An apparatus according to claim 14, wherein said pressure-applying element is so positioned as to apply pressure on a respective bottom edge of two adjacent blocks thereabove.

16. An apparatus according to claim 14, wherein said pressure-applying element in mounted to a longitudinal support member.

17. An apparatus according to claim 16, wherein said pressure-applying element comprises a roller, rotatable about an axis defined by said longitudinal support member.

18. An apparatus according to claim 16, wherein said longitudinal support member is reciprocally moveable towards and away blocks engaged by said pressure-applying elements so as to selectively modulate the sustained pressure applied thereby.

19. An apparatus according to claim 18, wherein said pressure-applying station further comprises a top stopper above blocks engaged by said pressure-applying elements to maintain blocks in position when pressure is exerted thereon.

20. An apparatus according to claim 14, wherein said pressure applying elements are expandable so as to selectively modulate the sustained pressure applied thereby.

21. An apparatus according to claim 20, wherein said pressure-applying station further comprises a top stopper above blocks engaged by said pressure-applying elements to maintain blocks in position when pressure is exerted thereon.

22. An apparatus according to claim 7, wherein said pressure applying station comprises at least one top pressure-applying element and at least one bottom pressure-applying element, said top pressure-applying element being so positioned as to exert pressure on the top edge of a block thereunder, said bottom pressure-applying element being so positioned as to exert pressure on the bottom edge of a block thereabove.

23. An apparatus according to claim 14, wherein said top pressure-applying element is so positioned as to apply pressure on a respective top edge of two adjacent blocks thereunder, said bottom pressure-applying element being so positioned as to apply pressure on a respective bottom edge of two adjacent blocks thereon.

24. An apparatus according to claim 23, wherein said at least one top pressure-applying element is collinear with said at least one bottom pressure-applying element.

25. An apparatus according to claim 22, wherein said support comprises at least one panel member for supporting blocks thereon, said panel member configure to expose opposite bottom edges of blocks.

26. An apparatus according to claim 22, wherein said top pressure-applying element is mounted to a top longitudinal support member, said bottom pressure-applying element being mounted to a bottom longitudinal support member.

27. An apparatus according to claim 26, wherein said top pressure-applying element comprises a roller rotatable about an axis defined by said top longitudinal support member, said bottom pressure-applying element comprising roller rotatable about an axis defined by said bottom longitudinal support member.

28. An apparatus according to claim 26, wherein at least one of said top and bottom longitudinal support members is reciprocally moveable towards and away blocks engaged by said top or bottom pressure-applying elements so as to selectively modulate the sustained pressure applied thereby.

29. An apparatus according to claim 22, wherein said pressure applying elements are expandable so as to selectively modulate the sustained pressure applied thereby.

30. An apparatus according to claim 7, wherein said pressure-applying element comprises a pressure-applying roller.

31. An apparatus according to claim 1, wherein said a pressure-applying station is so configured as to selectively modulate the sustained pressure exerted on blocks.

32. An apparatus according to claim 1, wherein said impacting station comprises at least one impacting element.

33. An apparatus according to claim 32, wherein said impacting element comprises a protruding member.

34. An apparatus according to claim 33, wherein said protruding element comprises a chain member.

35. An apparatus according to claim 32, wherein said impacting element is mounted to an actuator.

36. An apparatus according to claim 35, wherein said actuator is a rotatable longitudinal member.

37. An apparatus according to claim 35, wherein said actuator so moves said impacting element as to repeatedly and interruptingly impact blocks.

38. An apparatus according to claim 32, wherein said impacting element is so positioned as to impact the top edge of blocks thereunder.

39. An apparatus according to claim 38, wherein said impacting element is positioned as to impact the top edge of two adjacent blocks thereunder.

40. An apparatus according to claim 32, wherein said impacting element is positioned as to impact the bottom edge of blocks thereabove.

41. An apparatus according to claim 40, wherein said impacting element is positioned as to impact the bottom edge of two adjacent blocks thereabove.

42. An apparatus according to claim 32, wherein said impacting station comprises at least one top impacting element and at least one bottom impacting element, said top impacting element being so positioned as to impact the top edge of a block thereunder, said bottom impacting element being so positioned as to impact the bottom edge of a block thereabove.

43. An apparatus according to claim 42, wherein said at least one top and bottom impacting elements are collinear, said top impacting element impacting the adjacent top edges of two adjacent blocks thereunder, said bottom impacting element impacting the adjacent bottom edges of two adjacent blocks thereover.

44. An apparatus according to claim 1, wherein said a translational displacer comprises a push-member for pushing blocks along said support.

45. An apparatus according to claim 44, wherein said push member is mounted to an actuator at one end for translational movement thereof, said push-member comprising an opposite free end including a block-engaging member for engaging blocks during said translational displacement.

46. An apparatus according to claim 1, wherein said translational displacer comprises an actuation assembly mounted to said multi-station block-texture modifier so as to be displaced along the length of said support.

47. An apparatus according to claim 2, wherein said polishing station comprises at least polishing element for polishing blocks.

48. An apparatus according to claim 47, wherein said polishing element comprises a brush.

49. An apparatus according to claim 47, wherein said polishing element is mounted to an actuator.

50. An apparatus according to claim 49, wherein said actuator is a rotatable longitudinal member.

51. An apparatus according to claim 49, wherein said actuator so moves said polishing element as to polish blocks.

52. An apparatus according to claim 47, wherein said polishing element is so positioned as to polish the top edge of blocks thereunder.

53. An apparatus according to claim 47, wherein said polishing element is so positioned as to polish the adjacent top edges of two adjacent blocks thereunder.

54. An apparatus according to claim 47, wherein said polishing element is so positioned as to polish the bottom edge of blocks thereabove.

55. An apparatus according to claim 54, wherein said polishing element is positioned as to impact the bottom edge of two adjacent blocks thereabove.

56. An apparatus according to claim 47, wherein said impacting station comprises at least one top polishing element and at least one bottom polishing element, said top polishing element being so positioned as to polish the top edge of a block thereunder, said bottom polishing element being so positioned as to polish the bottom edge of a block thereabove.

57. An apparatus according to claim 56, wherein said at least one top and bottom polishing elements are collinear, said top polishing element polishing the adjacent top edges of two adjacent blocks thereunder, said bottom polishing element polishing the adjacent bottom edges of two adjacent blocks thereabove.

* * * * *